US009899162B2

(12) United States Patent
Chen

(10) Patent No.: US 9,899,162 B2
(45) Date of Patent: Feb. 20, 2018

(54) KEYBOARD

(71) Applicant: PRIMAX ELECTRONICS LTD., Taipei (TW)

(72) Inventor: Chung-Yuan Chen, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 0 days.

(21) Appl. No.: 15/257,719

(22) Filed: Sep. 6, 2016

(65) Prior Publication Data

US 2018/0019080 A1 Jan. 18, 2018

(30) Foreign Application Priority Data

Jul. 15, 2016 (TW) ..... 105122445 A

(51) Int. Cl.

| | |
|---|---|
| ***H01H 9/26*** | (2006.01) |
| ***H01H 13/72*** | (2006.01) |
| ***H01H 13/76*** | (2006.01) |
| ***H01H 13/7065*** | (2006.01) |
| ***H01H 9/56*** | (2006.01) |
| ***H01H 13/81*** | (2006.01) |
| ***H01H 13/85*** | (2006.01) |
| ***H01H 13/83*** | (2006.01) |

(52) U.S. Cl.

CPC ..... *H01H 13/7065* (2013.01); *H01H 9/56* (2013.01); *H01H 13/81* (2013.01); *H01H 13/83* (2013.01); *H01H 13/85* (2013.01); *H01H 2203/028* (2013.01); *H01H 2203/058* (2013.01); *H01H 2207/026* (2013.01); *H01H 2215/03* (2013.01); *H01H 2219/048* (2013.01); *H01H 2219/062* (2013.01); *H01H 2221/07* (2013.01)

(58) Field of Classification Search

CPC .. H01H 3/00; H01H 3/02; H01H 3/12; H01H 5/04; H01H 13/00; H01H 13/02; H01H 13/04; H01H 13/10; H01H 13/12; H01H 13/14; H01H 13/20; H01H 13/50; H01H 13/52; H01H 13/70; H01H 13/7006; H01H 13/705; H01H 13/84; H01H 2003/00; H01H 2003/007; H01H 2003/12; H01H 2215/03

USPC ..... 200/310, 5 A, 5 R, 511–512, 520, 521, 200/308, 311, 313, 314, 317, 337, 341, 200/343, 345, 292, 329

See application file for complete search history.

(56) References Cited

U.S. PATENT DOCUMENTS

| | | | | |
|---|---|---|---|---|
| 7,057,125 | B1 * | 6/2006 | Tsai | H01H 3/125 200/310 |
| 2012/0006666 | A1 * | 1/2012 | Chang | H01H 13/84 200/5 A |

* cited by examiner

*Primary Examiner* — Anthony R. Jimenez
(74) *Attorney, Agent, or Firm* — Kirton McConkie; Evan R. Witt

(57) ABSTRACT

A keyboard includes a base plate, a pressure sensing layer, a first key structure and a second key structure. The pressure sensing layer includes plural pressure sensing regions. Each of the first key structure and the second key structure corresponds to a pressure sensing region. Moreover, the first key structure and the second key structure are located over the corresponding pressure sensing regions. In response to different magnitudes of the depressing force, the corresponding pressure sensing regions are pushed by the first key structure and the second key structure. Consequently, the corresponding pressure sensing regions generate different pressure sensing signals. The pressure sensing layer can replace plural pressure sensing element. Consequently, the assembling process is simplified, and the assembling cost is reduced.

11 Claims, 11 Drawing Sheets

KEYBOARD

FIELD OF THE INVENTION

The present invention relates to a keyboard, and more particularly to a keyboard with a mechanical key structure.

BACKGROUND OF THE INVENTION

Generally, the widely-used peripheral input device of a computer system includes for example a mouse, a keyboard, a trackball, or the like. Via the keyboard, characters or symbols can be directly inputted into the computer system. As a consequence, most users and most manufacturers of input devices pay much attention to the development of keyboards. As known, a keyboard with scissors-type connecting elements is one of the widely-used keyboards.

The key structure of a keyboard will be described as follows. The key structure comprises a scissors-type connecting element. FIG. 1 is a schematic side cross-sectional view illustrating a key structure of a conventional keyboard. As shown in FIG. 1, the conventional key structure 1 comprises a keycap 11, a scissors-type connecting element 12, a rubbery elastomer 13, a membrane switch circuit member 14 and a base plate 15. The keycap 11, the scissors-type connecting element 12, the rubbery elastomer 13 and the membrane switch circuit member 14 are supported by the base plate 15. The scissors-type connecting element 12 is used for connecting the base plate 15 and the keycap 11.

The membrane switch circuit member 14 comprises plural key intersections (not shown). When one of the plural key intersections is triggered, a corresponding key signal is generated. The rubbery elastomer 13 is disposed on the membrane switch circuit member 14. Each rubbery elastomer 13 is aligned with a corresponding key intersection. When the rubbery elastomer 13 is depressed, the rubbery elastomer 13 is subjected to deformation to push the corresponding key intersection of the membrane switch circuit member 14. Consequently, the corresponding key signal is generated.

The scissors-type connecting element 12 is arranged between the base plate 15 and the keycap 11, and the base plate 15 and the keycap 11 are connected with each other through the scissors-type connecting element 12. The scissors-type connecting element 12 comprises a first frame 121 and a second frame 122. A first end of the first frame 121 is connected with the keycap 11. A second end of the first frame 121 is connected with the base plate 15. The rubbery elastomer 13 is enclosed by the scissors-type connecting element 12. Moreover, the first frame 121 comprises a first keycap post 1211 and a first base plate post 1212. The first frame 121 is connected with the keycap 11 through the first keycap post 1211. The first frame 121 is connected with the base plate 15 through the first base plate post 1212. The second frame 122 is combined with the first frame 121. A first end of the second frame 122 is connected with the base plate 15. A second end of the second frame 122 is connected with the keycap 11. Moreover, the second frame 122 comprises a second keycap post 1221 and a second base plate post 1222. The second frame 122 is connected with the keycap 11 through the second keycap post 1221. The second frame 122 is connected with the base plate 15 through the second base plate post 1222.

The operations of the conventional key structure 1 in response to the depressing action of the user will be illustrated as follows. Please refer to FIG. 1 again. When the keycap 11 is depressed, the keycap 11 is moved downwardly to push the scissors-type connecting element 12 in response to the depressing force. As the keycap 11 is moved downwardly relative to the base plate 15, the keycap 11 pushes the corresponding rubbery elastomer 13. At the same time, the rubbery elastomer 13 is subjected to deformation to push the membrane switch circuit member 14 and trigger the corresponding key intersection of the membrane switch circuit member 14. Consequently, the membrane switch circuit member 14 generates a corresponding key signal. When the keycap 11 is no longer depressed by the user, no external force is applied to the keycap 11 and the rubbery elastomer 13 is no longer pushed by the keycap 11. In response to the elasticity of the rubbery elastomer 13, the rubbery elastomer 13 is restored to its original shape to provide an upward elastic restoring force. Consequently, the keycap 11 is returned to its original position where it is not depressed.

With increasing development of science and technology, a mechanical key structure is introduced into the market. The mechanical key structure can provide better tactile feel. FIG. 2 is a schematic side cross-sectional view illustrating a conventional mechanical key structure. As shown in FIG. 2, the mechanical key structure 2 comprises a keycap (not shown), a pedestal 21, an upper cover 22, a push element 23, a linkage element 24, a first spring strip 25, a second spring strip 26 and a circuit board (not shown). The circuit board is located outside the pedestal 21. The pedestal 21 is covered by the upper cover 22. The upper cover 22 has an opening 221. The linkage element 24 is located at a middle region of the pedestal 21. Moreover, the linkage element 24 is movable upwardly or downwardly relative to the pedestal 21. The second spring strip 26 is partially disposed within the pedestal 21, and arranged between the linkage element 24 and the first spring strip 25. The push element 23 and the linkage element 24 are collaboratively disposed on the pedestal 21. The push element 23 is penetrated through the opening 221 of the upper cover 22 and coupled with the keycap. Moreover, the first spring strip 25 and the second spring strip 26 are electrically connected with the circuit board.

Please refer to FIG. 2 again. The linkage element 24 has a protrusion structure 241. The protrusion structure 241 is extended from a sidewall of the linkage element 24 toward the first spring strip 25. Moreover, the first spring strip 25 comprises a fixing part 251 and an elastic part 252. The fixing part 251 is fixed on the pedestal 21. The elastic part 252 is extended from the fixing part 251. Moreover, the elastic part 252 is contacted with the protrusion structure 241 of the linkage element 24. Consequently, the elastic part 252 is movable relative to the fixing part 251.

When the keycap is depressed, the keycap is moved downwardly to push the push element 23. Consequently, the linkage element 24 connected with the push element 23 is moved downwardly. As the linkage element 24 is moved downwardly, the protrusion structure 241 of the linkage element 24 is contacted with the elastic part 252 and moved downwardly along the elastic part 252. While the linkage element 24 is quickly moved in response to the depressing force of the user, the linkage element 24 is quickly moved across the elastic part 252, and the elastic part 252 is pushed by the protrusion structure 241 of the linkage element 24. Consequently, the elastic part 252 is moved relative to the fixing part 251 to collide with the second spring strip 26. Since the first spring strip 25 and the second spring strip 26 are contacted with each other, the circuit board outputs a corresponding key signal. Moreover, while the first spring strip 25 and the second spring strip 26 are contacted with each other, a click sound is generated. Due to the click sound, the user can feel the depressing feedback.

Since the mechanical key structure 2 generates the click sound to provide the feedback feel while the keycap is depressed, the mechanical key structure 2 is favored by some users. However, the conventional mechanical key structure 2 still has some drawbacks. For example, the first spring strip 25 and the second spring strip 26 have to be protruded out of the pedestal 21 in order to be electrically connected with the circuit board. If the first spring strip 25 and the second spring strip 26 are not electrically connected with the circuit board, the operation of the mechanical key structure 2 cannot generate the key signal. Moreover, the keyboard comprises plural mechanical key structures 2. For assembling the keyboard, it is necessary to sequentially electrically connect the first spring strips 25 and the second spring strips 26 of the plural mechanical key structures 2 with the circuit board. In other words, the process of assembling the keyboard is time-consuming and labor-intensive, and thus the assembling cost is high.

Therefore, there is a need of providing a keyboard with reduced assembling cost.

SUMMARY OF THE INVENTION

The present invention provides a keyboard with reduced assembling cost.

In accordance with an aspect of the present invention, there is provided a keyboard. The keyboard includes a base plate, a pressure sensing layer, a first key structure and a second key structure. The pressure sensing layer is located over the base plate. The pressure sensing layer includes plural pressure sensing regions. Each of the plural pressure sensing regions is configured to receive a first force or a second force. The first key structure is located over the pressure sensing layer, and aligned with the corresponding pressure sensing region. When the corresponding pressure sensing region is pushed by the first key structure, the first key structure provides the first force or the second force to the corresponding pressure sensing region. The second key structure is arranged beside the first key structure, located over the pressure sensing layer, and aligned with the corresponding pressure sensing region. When the corresponding pressure sensing region is pushed by the second key structure, the second key structure provides the first force or the second force to the corresponding pressure sensing region. When the first key structure or the second key structure is depressed with the first force or the second force, the keyboard outputs a corresponding pressure sensing signal.

In an embodiment, the keyboard further includes a circuit board and a controlling unit. The circuit board is electrically connected with the pressure sensing layer. The controlling unit is disposed on the circuit board and electrically connected with the pressure sensing layer. A lookup table recording a relationship between the first force, the second force, a first travelling distance and a second travelling distance is previously stored in the controlling unit. The controlling unit acquires the first travelling distance according to the first force and outputs a first pressure sensing signal corresponding to the first travelling distance, or the controlling unit acquires the second travelling distance according to the second force, and outputs a second pressure sensing signal corresponding to the second travelling distance.

In an embodiment, when the controlling unit judges that the corresponding pressure sensing region receives the first force, the controlling unit acquires the first travelling distance corresponding to the first force according to the lookup table, and outputs the first pressure sensing signal. When the controlling unit judges that the corresponding pressure sensing region receives the second force, the controlling unit acquires the second travelling distance corresponding to the second force according to the lookup table, and outputs the second pressure sensing signal.

In an embodiment, the keyboard further includes a circuit board and a controlling unit. The circuit board is electrically connected with the pressure sensing layer. The controlling unit is disposed on the circuit board and electrically connected with the pressure sensing layer. The controlling unit outputs a first pressure sensing signal corresponding to the first force according to the first force, or the controlling unit outputs a second pressure sensing signal corresponding to the second force according to the second force.

From the above descriptions, the present invention provides the keyboard with the key structure. The key structure is equipped with the light-emitting element and the movable element that is made of a light-transmissible material. Consequently, the key structure has the illuminating function. Moreover, the keyboard has the pressure sensing layer. By means of the pressure sensing layer, the key structure of the keyboard generates different pressure sensing signals according to different magnitudes of the depressing force. Since the functions of the keyboard are increased, the drawbacks of the conventional technologies are overcome. Optionally, the key structure is equipped with the spring strip according to the requirements of the user. The key structure with the spring strip can provide the depressing feedback to the user. Moreover, the key structure without the spring strip has reduced volume, and thus the key structure is slim. Moreover, the pressure sensing layer of the keyboard comprises plural pressure sensing regions. The electrical traces of the plural pressure sensing regions are formed in the pressure sensing layer, and a single electrical connection part is located at a side of the pressure sensing layer. The pressure sensing layer is electrically connected with the circuit board through the electrical connection part. Consequently, the electrical connection between the pressure sensing layer and the circuit board is achieved. In comparison with the conventional technology, the assembling cost is reduced.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

For solving the drawbacks of the conventional technologies, the present invention provides a keyboard.

Figure 1:
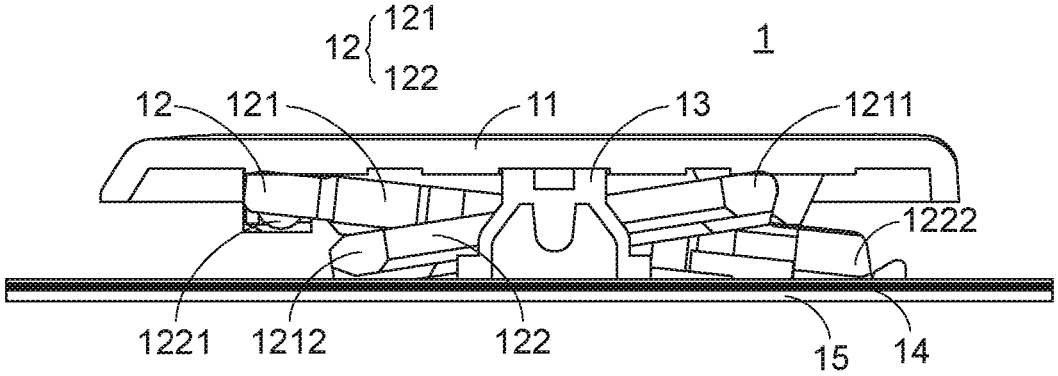
FIG.1 PRIOR ART
FIG. 1 is a schematic side cross-sectional view illustrating a key structure of a conventional keyboard.
Figure 2:
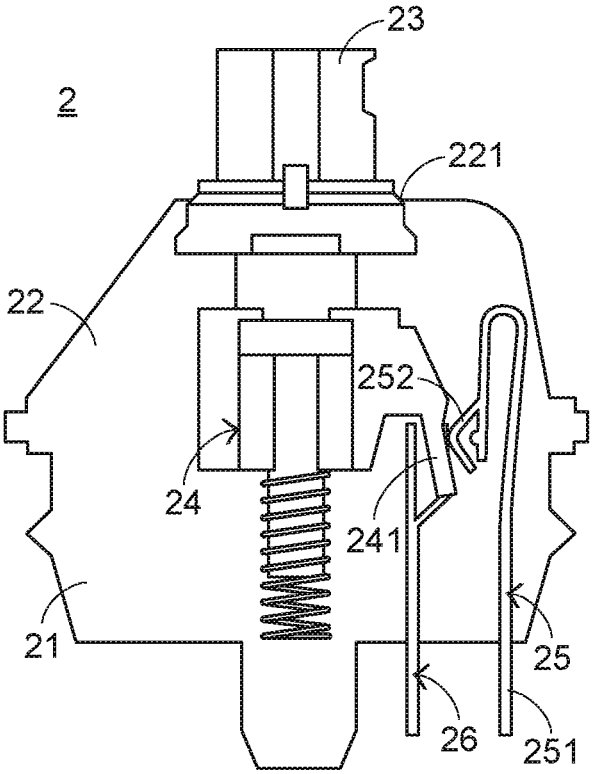
FIG.2 PRIOR ART
FIG. 2 is a schematic side cross-sectional view illustrating a conventional mechanical key structure.
Figure 3:
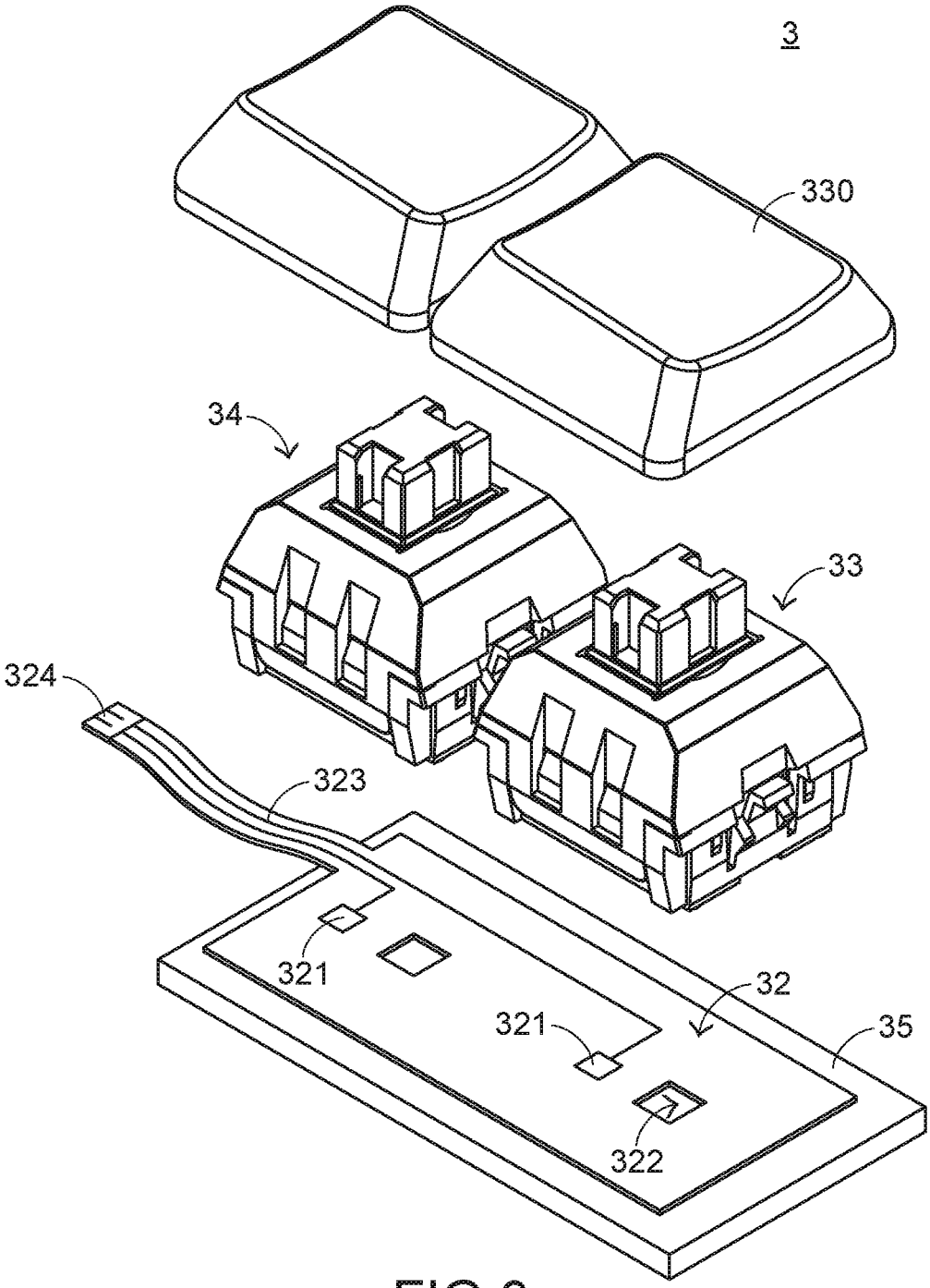
FIG. 3 is a schematic exploded view illustrating a portion of a keyboard according to a first embodiment of the present invention.
Figure 4:
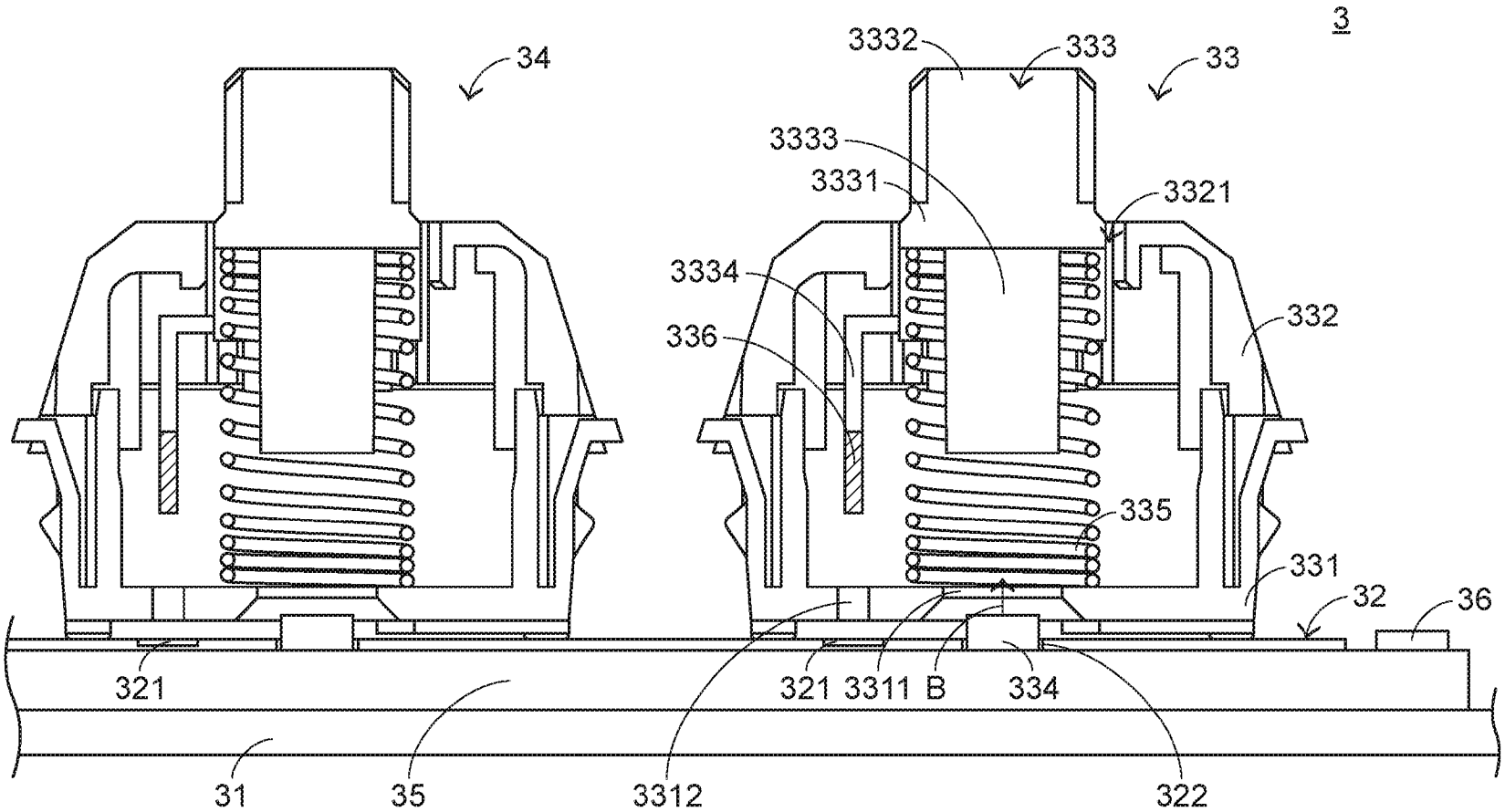
FIG. 4 is a schematic side cross-sectional view illustrating a portion of the keyboard according to the first embodiment of the present invention.

FIG. 3 is a schematic exploded view illustrating a portion of a keyboard according to a first embodiment of the present invention. FIG. 4 is a schematic side cross-sectional view illustrating a portion of the keyboard according to the first embodiment of the present invention. As shown in FIGS. 3 and 4, the keyboard 3 comprises a base plate 31, a pressure sensing layer 32, a first key structure 33, a second key structure 34, a circuit board 35 and a controlling unit 36. It is noted that the keyboard comprises plural key structures. For succinctness and clarification, only the first key structure 33 and the second key structure 34 are shown in the drawings. The pressure sensing layer 32 is located over the base plate 31, and disposed on a top surface of the circuit board 35. The pressure sensing layer 32 comprises plural pressure sensing regions 321. Each pressure sensing region 321 is aligned with a corresponding key structure. When the pressure sensing region 321 is pushed by the corresponding key structure, the pressure sensing region 321 receives a first force or a second force. The first key structure 33 is located over the pressure sensing layer 32. Moreover, the first key structure 33 is aligned with the corresponding pressure sensing region 321 of the pressure sensing layer 32. When the pressure sensing region 321 is pushed by the first key structure 33 with the first force or the second force, the keyboard 3 generates a first pressure sensing signal or a second pressure sensing signal. Similarly, the second key structure 34 is arranged beside the first key structure 33 and located over the pressure sensing layer 32. Moreover, the second key structure 34 is aligned with the corresponding pressure sensing region 321 of the pressure sensing layer 32. When the corresponding pressure sensing region 321 is pushed by the second key structure 34 with the first force or the second force, the keyboard 3 generates the first pressure sensing signal or the second pressure sensing signal.

The circuit board 35 is electrically connected with the pressure sensing layer 32. The controlling unit 36 is disposed on the circuit board 35 and electrically connected with the pressure sensing layer 32. According to the magnitude of the force received by the pressure sensing layer 32, the controlling unit 36 judges the travelling distance of the key structure and generates the corresponding pressure sensing signal. For example, the first key structure 33 is depressed by the user. When the magnitude of the force exerted on the first key structure 33 is acquired by the controlling unit 36 through the pressure sensing layer 32, the controlling unit 36 judges the magnitude of the exerted force. If the exerted force is the first force, the controlling unit 36 acquires a first travelling distance corresponding to the first force and generates the first pressure sensing signal corresponding to the first travelling distance. If the exerted force is the second force, the controlling unit 36 acquires a second travelling distance corresponding to the second force and generates the second pressure sensing signal corresponding to the second travelling distance. The ways of judging the travelling distance of the key structure and generating the corresponding pressure sensing signal by the controlling unit 36 will be described later. In an embodiment, the circuit board 35 is a printed circuit board (PCB), and the controlling unit 36 is a firmware component that is disposed on the circuit board 35. It is noted that numerous modifications and alterations may be made while retaining the teachings of the invention. For example, in another embodiment, the controlling unit is a microprocessor that is disposed on the circuit board.

The inner components of the first key structure 33 will be described as follows. Please refer to FIGS. 3 and 4 again. The first key structure 33 comprises a keycap 330, a pedestal 331, an upper cover 332, a movable element 333, a light-emitting element 334, an elastic element 335 and an elastomer 336. The pedestal 331 comprises a light-transmissible region 3311 and a pedestal opening 3312. The light-transmissible region 3311 is formed in a lower portion of the pedestal 331, and aligned with the light-emitting element 334. The pedestal opening 3312 is also formed in the lower portion of the pedestal 331. Moreover, the pedestal opening 3312 is arranged beside the light-transmissible region 3311. The pedestal 331 is covered by the upper cover 332. Moreover, the upper cover 332 has an upper cover opening 3321 corresponding to the movable element 333. The keycap 330 is connected with a first end of the movable element 333 through the upper cover opening 3321. The movable element 333 is installed on the pedestal 331, and penetrated through the upper cover opening 3321 so as to be connected with the keycap 330. When the movable element 333 is depressed by the user, the movable element 333 is moved relative to the pedestal 331. The elastic element 335 is sheathed around the movable element 333. The light-emitting element 334 is disposed on a top surface of the circuit board 35, and located under the pedestal 331. The light-emitting element 334 is electrically connected with the circuit board 35 to emit a light beam B. Moreover, the light-emitting element 334 emits the light beam B to the movable element 333. The elastomer 336 is located near the movable element 333. Moreover, when the elastomer 336 is pushed by the movable element 333, the elastomer 336 is subjected to deformation and penetrated through the pedestal opening 3312. Consequently, the corresponding pressure sensing region 321 is pressed by the elastomer 336.

In an embodiment, the elastic element 335 is a helical spring, and the light-emitting element 334 is a light emitting diode (LED). Moreover, the light-transmissible region 3311 of the pedestal 31 is an opening or a light-transmissible structure that is made of a transparent material. Consequently, the light beam B can pass through the light-transmissible region 3311. Moreover, each pressure sensing region 321 of the pressure sensing layer 32 has a perforation 322. The light-emitting element 334 is inserted into the corresponding perforation 322 and disposed on the top surface of the circuit board 35.

Please refer to FIG. 4 again. The movable element 333 comprises a main body 3331, a coupling part 3332, a light guide post 3333 and an extension part 3334. The coupling part 3332 is located at a first end of the main body 3331 and connected with the keycap 330. The light guide post 3333 is located at a second end of the main body 3331, and located near the light-emitting element 334. The light guide post 3333 is used for guiding the light beam B to the keycap 330 through the coupling part 3332. The extension part 3334 is extended externally from the main body 3331, and aligned with the elastomer 336. That is, the elastomer 336 is arranged beside the light guide post 3333, and aligned with the pedestal opening 3312. While the movable element 333 is moved relative to the pedestal 331, the elastomer 336 is pushed by the extension part 3334, and the elastomer 336 is subjected to deformation and penetrated through the pedestal opening 3312. Consequently, the corresponding pressure sensing region 321 is pressed by the elastomer 336. Moreover, the elastic element 335 is sheathed around the light guide post 3333 and contacted with the pedestal 331. The elastic element 335 provides an elastic force to the movable element 333. In response to the elastic force, the movable element 333 is moved upwardly relative to the pedestal 331.

In this embodiment, the main body 3331, the coupling part 3332, the light guide post 3333 and the extension part 3334 are made of a light-transmissible material. Moreover, the light guide post 3333 is assembled with the lower portion of the main body 3331, and the extension part 3334 is assembled with a sidewall of the main body 3331. The inner components of the second key structure 34 are similar to those of the first key structure 33, and are not redundantly described herein.

Figure 5:
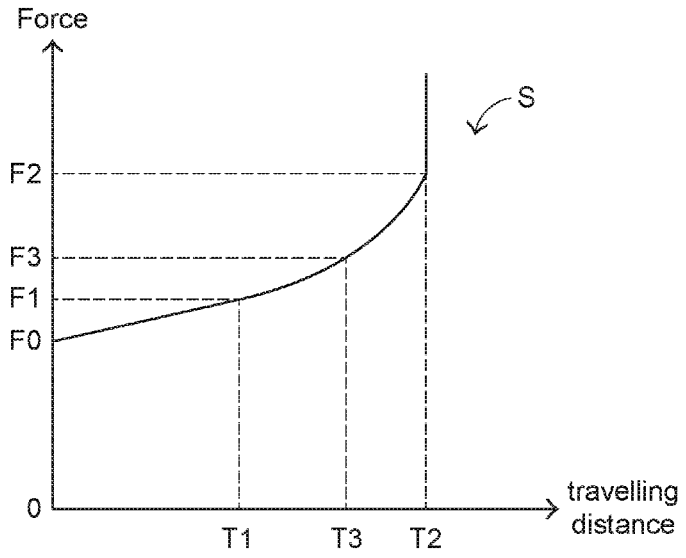
FIG. 5 is a plot illustrating the relationship between forces and travelling distances in a lookup table of the controlling unit of the keyboard according to the first embodiment of the present invention.

The operations of the controlling unit 36 will be described as follows. FIG. 5 is a plot illustrating the relationship between forces and travelling distances in a lookup table of the controlling unit of the keyboard according to the first embodiment of the present invention. Please refer to FIGS. 3, 4 and 5. The lookup table S is previously stored in the controlling unit 36. The relationship between the magnitudes of plural forces and the magnitudes of plural travelling distances is recorded in the lookup table S. In this context, the force in the lookup table S is the force detected by the pressure sensing region 321, and the travelling distance in the lookup table S is the moving distance of the keycap 330 of the first key structure 33. The curve as shown in FIG. 5 indicates the relationship between the magnitudes of plural forces and the magnitudes of plural travelling distances. In the curve of FIG. 5, the horizontal axis indicates the magnitudes of the travelling distances in the lookup table S, and the vertical axis indicates the magnitudes of forces in the lookup table S.

Please refer to FIG. 5 again. When the travelling distance is zero, the corresponding force is F0. That is, the keycap 330 is not moved in response to the exerted force F0 on the first key structure 33. The reason why the keycap 330 is not moved is that the force F0 is balanced by the elastic force of the elastic element 335. When the travelling distance is in the range between zero and T1, the exerted force is in the range between F0 and F1. That is, the exerted force F1 can overcome the elastic force and result in the moving distance T1 of the keycap 330. While the travelling distance of the keycap 330 is changed from zero to T1, the elastomer 336 is not subjected to deformation. When the travelling distance is in the range between T1 and T2, the exerted force is in the range between F1 and F2. That is, as the exerted force is gradually increased, the elastomer 336 is subjected to deformation and the keycap 330 is continuously moved in response to the deformation of the elastomer 336. When the exerted force is increased to F2, the deformation of the elastomer 336 reaches the elastic limit. Under this circumstance, the moving distance of the keycap 330 is only T2. As the exerted force is increased to the magnitude larger than F2, the keycap 330 is no longer moved. The segment between the travelling distance T1 and the travelling distance T2 is nonlinear.

Figure 6:
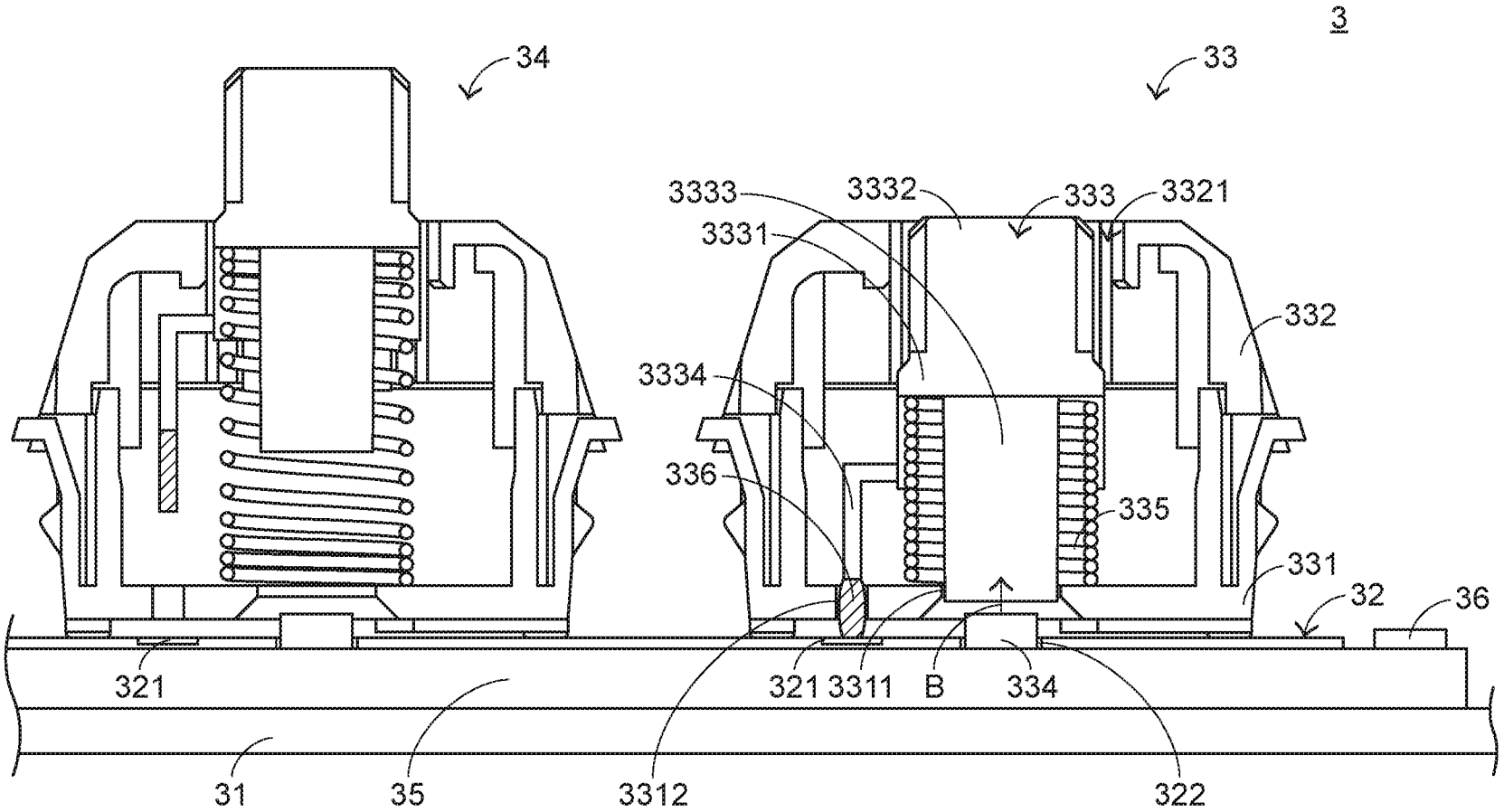
FIG. 6 is a schematic side cross-sectional view illustrating the first key structure of the keyboard according to the first embodiment of the present invention, in which the keycap is depressed.

The operations of the first key structure 33 of the keyboard 3 in response to the depressing action of the user will be illustrated in more details as follows. Please refer to FIGS. 3, 4, 5 and 6. FIG. 6 is a schematic side cross-sectional view illustrating the first key structure of the keyboard according to the first embodiment of the present invention, in which the keycap is depressed. While the keycap 330 of the first key structure 33 is depressed lightly, the keycap 330 is moved downwardly to push the movable element 333 in response to the light depressing force. As the keycap 330 is moved downwardly, the movable element 333 is moved downwardly relative to the pedestal 331. While the movable element 333 is moved downwardly, the elastic element 353 is compressed by the main body 3331 of the movable element 333 and the keycap 330 is moved to generate a travelling distance (see FIG. 6). Moreover, as the main body 3331 is moved downwardly, the extension part 3334 connected with the main body 3331 is correspondingly moved downwardly. Since the elastomer 336 is connected with the extension part 3334, the elastomer 336 is penetrated through the pedestal opening 3312 to press the corresponding pressure sensing region 321 with a first force. After the pressure sensing region 321 receives the first force and senses the magnitude of the first force, the magnitude of the first force is transmitted from the pressure sensing region 321 to the controlling unit 36. According to the magnitude of the first force (e.g., F3) and the lookup table S, the controlling unit 36 acquires a first travelling distance T3 corresponding to the first force F3. In addition, the controlling unit 36 generates the first pressure sensing signal corresponding to the first travelling distance T3.

When the keycap 330 is no longer depressed by the user, no external force is applied to the keycap 330. In response to the elasticity of the elastic element 335, the compressed elastic element 335 is restored to its original shape to provide an elastic force to the movable element 333. In response to the elastic force, the movable element 333 is moved upwardly relative to the pedestal 331 and returned to its original position where it is not depressed.

While the keycap 330 is depressed heavily, the actions of the first key structure 33 are similar to the above actions of lightly depressing the keycap 330. In contrast, the pressure sensing region 321 receives a second force, and the magnitude of the second force is transmitted from the pressure sensing region 321 to the controlling unit 36. According to the magnitude of the second force (e.g., F2) and the lookup table S, the controlling unit 36 acquires a second travelling distance T2 corresponding to the second force F2. In addition, the controlling unit 36 generates the second pressure sensing signal corresponding to the second travelling distance T2.

In the above embodiment, the first key structure 3 of the keyboard 3 is equipped with an elastomer 336. The relationship between the magnitudes of plural forces and the magnitudes of plural travelling distances is recorded in the lookup table S. The lookup table S is previously stored in the controlling unit 36. According to the lookup table S, the controlling unit 36 can acquire the travelling distance of the keycap 330 corresponding to the exerted force. Consequently, the function of sensing the multi-stage pressure can be achieved. Since different commands are executed by the keyboard 3 according to different pressure sensing signals, the functions of the first key structure 33 are increased. Moreover, the pressure sensing layer 32 of the keyboard 3 comprises the plural pressure sensing regions 321. The electrical traces 323 of the plural pressure sensing regions 321 are formed in the pressure sensing layer 32, and an electrical connection part 324 is located at a side of the pressure sensing layer 32. The pressure sensing layer 32 is electrically connected with the circuit board 35 through the electrical connection part 324. Consequently, the electrical connection between the pressure sensing layer 32 and the circuit board 35 is achieved. In comparison with the conventional technology, it is not necessary to sequentially electrically connect the key structures with the circuit board according to the present invention. In other words, the process of assembling the keyboard is time-saving, and the assembling cost is reduced.

The following three aspects should be specially described. Firstly, the keyboard 3 can be operated in different operation modes according to settings. For example, the keyboard 3 may be selectively in a travelling distance detection mode or a pressure detection mode through the settings of the controlling unit 36. The operations of the keyboard 3 in the travelling distance detection mode are similar to those mentioned above. When the keyboard 3 is in the pressure detection mode through the settings of the controlling unit 36, the controlling unit 36 directly outputs the pressure sensing signal corresponding to the magnitude of the received force. While the keycap 330 of the first key structure 33 is depressed lightly, the operations of the first key structure 33 are similar to the above lightly-depressing operations. After the magnitude of the first force is transmitted from the pressure sensing region 321 to the controlling unit 36, the controlling unit 36 generates the first pressure sensing signal corresponding to the first force. While the keycap 330 of the first key structure 33 is depressed lightly, the operations of the first key structure 33 are similar to the above heavily-depressing operations. After the magnitude of the second force is transmitted from the pressure sensing region 321 to the controlling unit 36, the controlling unit 36 generates the second pressure sensing signal corresponding to the second force. In an embodiment, the keyboard 3 further comprises a switching element (e.g., a button or a switch) to change the operation mode. That is, the keyboard 3 can be operated in different operation modes in order to comply with different requirements of the user.

Secondly, the keyboard 3 can be operated in a combined mode of the travelling distance detection mode and the pressure detection mode according to settings. For example, the operation mode of the keyboard 3 is determined according to the range of the travelling distance of the look-up table S of FIG. 5. According to the settings of the controlling unit 36, the keyboard 3 is in the travelling distance detection mode when the travelling distance is in larger than or equal to zero and smaller than or equal to T2, and the keyboard 3 is in the pressure detection mode when the travelling distance is equal to T2. The operations of the keyboard 3 in the travelling distance detection mode are similar to those mentioned above. When the exerted force is increased to F2, the deformation of the elastomer 336 reaches the elastic limit. Under this circumstance, the keycap 330 is no longer moved, and the keyboard 3 enters the pressure detection mode according to the settings of the controlling unit 36. Even if the exerted force is increased, the controlling unit 36 can still output the pressure sensing signal corresponding to the exerted force in the pressure detection mode. Consequently, the keyboard 3 of the present invention can provide more functions.

Thirdly, the first key structure 33 and the second key structure 34 of the keyboard 3 can be set as consecutive buttons, whose functions are similar to accelerator pedals in cars. For example, when the key structure corresponding to the down arrow is continuously depressed by the user, the scroll bar shown on the computer window (not shown) is moved downwardly. While the key structure is depressed lightly, the scroll bar is moved downwardly at a slower speed. While the key structure is depressed heavily, the speed of moving the scroll bar downwardly is gradually increased. In some embodiments, the function of the consecutive button is applied to the game software to increase the convenience of operating the keyboard. Consequently, the keyboard 3 of the present invention provides the function of the consecutive button to increase the operating convenience.

Figure 7:
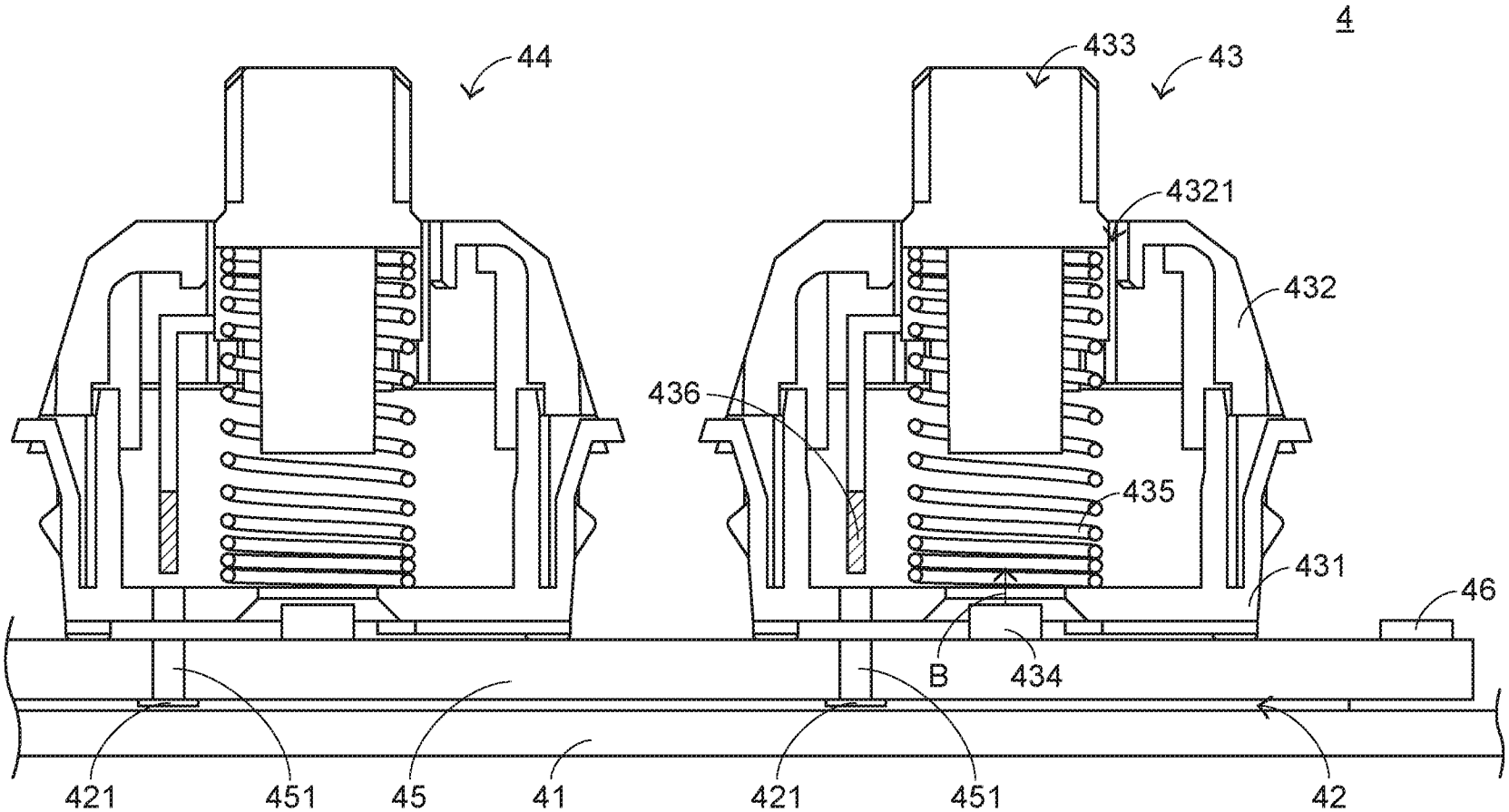
FIG. 7 is a schematic side cross-sectional view illustrating a portion of a keyboard according to a second embodiment of the present invention.

The present invention further provides a second embodiment, which is distinguished from the first embodiment. FIG. 7 is a schematic side cross-sectional view illustrating a portion of a keyboard according to a second embodiment of the present invention. As shown in FIG. 7, the keyboard 4 comprises a base plate 41, a pressure sensing layer 42, a first key structure 43, a second key structure 44, a circuit board 45 and a controlling unit 46. The pressure sensing layer 42 comprises plural pressure sensing regions 421. A lookup table S (see FIG. 5) recording the relationship between the magnitudes of plural forces and the magnitudes of plural travelling distances is previously stored in the controlling unit 46. The first key structure 43 comprises a keycap (not shown), a pedestal 431, an upper cover 432, a movable element 433, a light-emitting element 434, an elastic element 435 and an elastomer 436. The pedestal 431 comprises a light-transmissible region 4311 and a pedestal opening 4312. Moreover, the upper cover 432 has an upper cover opening 4321 corresponding to the movable element 433. The structures and functions of the components of the keyboard 4 which are identical to those of the first embodiment are not redundantly described herein. In comparison with the first embodiment, the position of the pressure sensing layer 42 of the keyboard 4 of this embodiment is distinguished.

Please refer to FIG. 7. The pressure sensing layer 42 is disposed on the base plate 41, and located near a bottom surface of the circuit board 45. The circuit board 45 comprises plural circuit board openings 451. Each circuit board opening 451 is aligned with the pedestal opening 4312 and the elastomer 436 of the corresponding key structure (e.g., the first key structure 43). While the keycap is depressed and the movable element 433 is correspondingly moved downwardly, the elastomer 436 connected with the movable element 433 is subjected to deformation and penetrated through the pedestal opening 4312 and the circuit board opening 451 sequentially. Consequently, the corresponding pressure sensing region 421 is pressed by the elastomer 436. In other words, the pressure sensing layer 42 of this embodiment is located under the circuit board 45.

Figure 8:
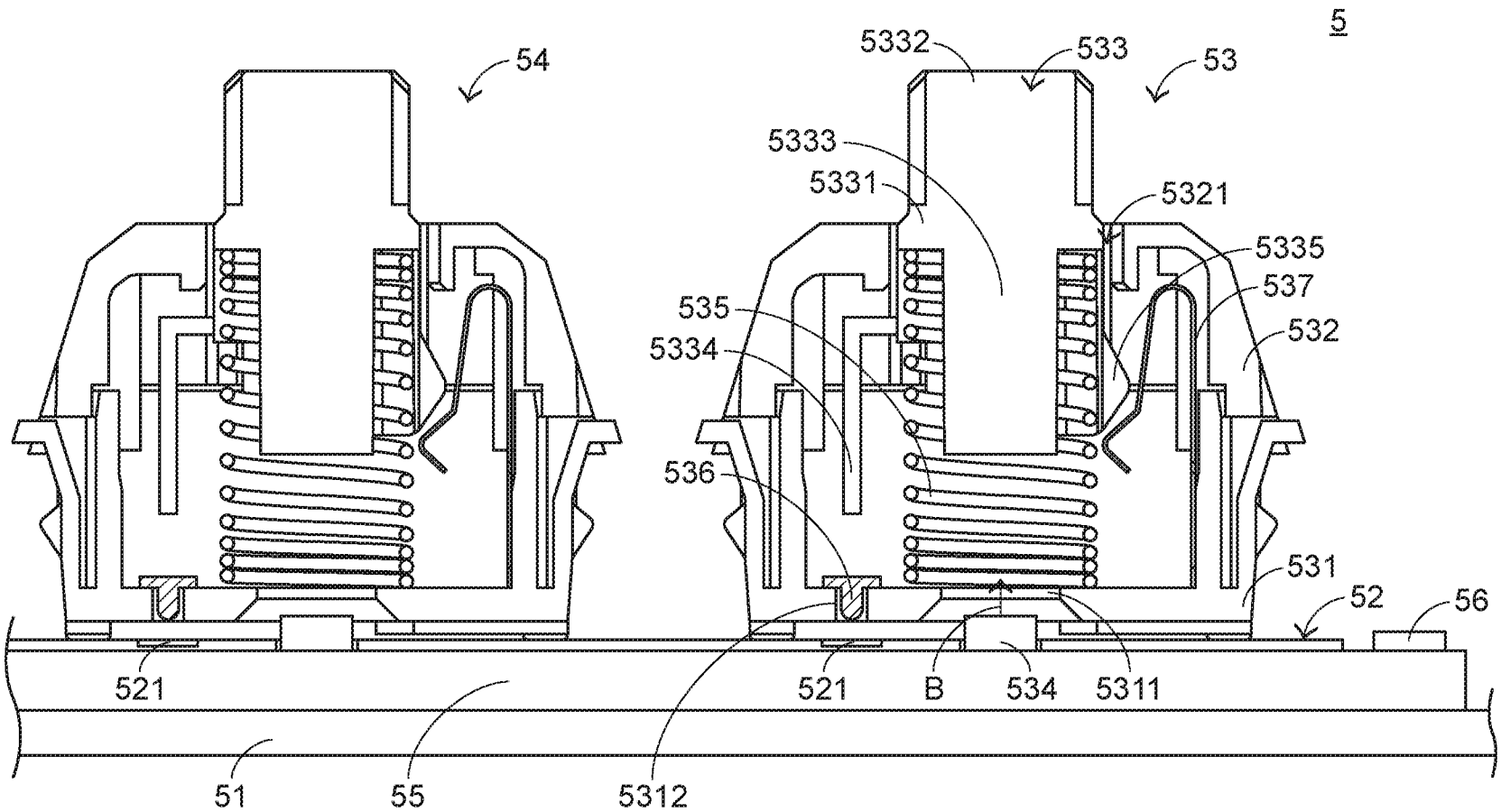
FIG. 8 is a schematic side cross-sectional view illustrating a portion of a keyboard according to a third embodiment of the present invention.

The present invention further provides a third embodiment, which is distinguished from the above embodiments. FIG. 8 is a schematic side cross-sectional view illustrating a portion of a keyboard according to a third embodiment of the present invention. As shown in FIG. 8, the keyboard 5 comprises a base plate 51, a pressure sensing layer 52, a first key structure 53, a second key structure 54, a circuit board 55 and a controlling unit 56. The pressure sensing layer 52 comprises plural pressure sensing regions 521. A lookup table S (see FIG. 5) recording the relationship between the magnitudes of plural forces and the magnitudes of plural travelling distances is previously stored in the controlling unit 56. The first key structure 53 comprises a keycap (not shown), a pedestal 531, an upper cover 532, a movable element 533, a light-emitting element 534, an elastic element 535, an elastomer 536 and a spring strip 537. The pedestal 531 comprises a light-transmissible region 5311 and a pedestal opening 5312. Moreover, the upper cover 532 has an upper cover opening 5321 corresponding to the movable element 533. The structures and functions of the components of the keyboard 5 which are identical to those of the above embodiments are not redundantly described herein. In comparison with the above embodiments, the first key structure 53 of this embodiment is distinguished.

The components of the first key structure 53 will be described as follows. In comparison with the first key structure 53 of the first embodiment, the first key structure 53 of this embodiment has the following three distinguished aspects. Firstly, the first key structure 33 further comprises the spring strip 537. Secondly, the structure of the movable element 533 is distinguished. Thirdly, the installation of the elastomer 536 is distinguished. Please refer to FIG. 8. The spring strip 537 is installed on the pedestal 531 and arranged beside a first side of the movable element 533. The movable element 533 comprises a main body 5331, a coupling part 5332, a light guide post 5333, an extension part 5334 and a push part 5335. The coupling part 5332 is located at a first end of the main body 5331 and connected with the keycap. The light guide post 5333 is located at a second end of the main body 5331, and located near the light-emitting element 534. The extension part 5334 is extended externally from the main body 5331, and arranged beside a second side of the light guide post 5333. Moreover, the extension part 5334 is aligned with the elastomer 536. The push part 5334 is extended externally from the main body 5331 and located near the spring strip 537. While the movable element 533 is moved relative to the pedestal 531, the push part 5334 is contacted with the spring strip 537. Consequently, the spring strip 537 is correspondingly swung to collide with the push part 5335. Meanwhile, a sound is generated.

In this embodiment, the coupling part 5332, the light guide post 5333, the extension part 5334 and the push part 5335 are integrally formed with the main body 5331. Moreover, the main body 5331, the coupling part 5332 and the light guide post 5333 are made of a light-transmissible material. In this embodiment, the light guide post 5333 is integrally formed with the main body 5331. In another embodiment, the light guide post 5333 is assembled with the lower portion of the main body 5331.

In this embodiment, the elastomer 536 is installed on the pedestal 531, and inserted into the pedestal opening 5312. Moreover, the elastomer 536 is not connected with the extension part 5334. That is, the elastomer 536 has a shape of an inverted cone. While the movable element 533 is moved relative to the pedestal 531, the extension part 5334 is moved with the main body 5331 to push the elastomer 536. The elastomer 536 is subjected to deformation and penetrated through the pedestal opening 5312. Consequently, the corresponding pressure sensing region 521 is pressed by the elastomer 536.

The operations of the first key structure 53 of the keyboard 5 in response to the depressing action of the user will be illustrated as follows. While the keycap is depressed lightly, the keycap is moved downwardly to push the movable element 533 in response to the light depressing force. As the keycap is moved downwardly, the movable element 533 is moved downwardly relative to the pedestal 51. As the movable element 533 is moved downwardly, the elastic element 535 is compressed by the main body 5331 of the movable element 533 and the keycap is moved to generate a travelling distance. Moreover, as the main body 5331 is moved downwardly, the extension part 5334 connected with the main body 5331 is correspondingly moved downwardly. Consequently, the elastomer 536 that is inserted in the pedestal opening 5312 is penetrated through the pedestal opening 5312 to press the corresponding pressure sensing region 521 with a first force. After the pressure sensing region 521 receives the first force and senses the magnitude of the first force, the magnitude of the first force is transmitted from the pressure sensing region 521 to the controlling unit 56. According to the similar operating principle of the first embodiment, the controlling unit 56 acquires a first travelling distance corresponding to the first force. In addition, the controlling unit 56 generates the first pressure sensing signal corresponding to the first travelling distance.

Moreover, while the movable element 533 is moved downwardly, the push part 5335 is correspondingly moved downwardly to push the spring strip 537. In response to the elasticity of the spring strip 537, the spring strip 537 is correspondingly swung to collide with the push part 5335. Consequently, a sound is generated. When the keycap is no longer depressed by the user, no external force is applied to the keycap. In response to the elasticity of the elastic element 535, the compressed elastic element 535 is restored to its original shape to provide an elastic force to the movable element 533. In response to the elastic force, the movable element 533 is moved upwardly relative to the pedestal 531 and returned to its original position where it is not depressed. The operations of heavily depressing the keycap are similar to those of lightly depressing the keycap, and are not redundantly described herein.

As mentioned above, the keyboard 5 of this embodiment is further equipped with the spring strip 537 and the push part 5335. While the keycap is depressed, the spring strip 537 and the push part 5335 of the first key structure 53 are activated to generate a sound. Consequently, the user can feel the depressing feedback.

Figure 9:
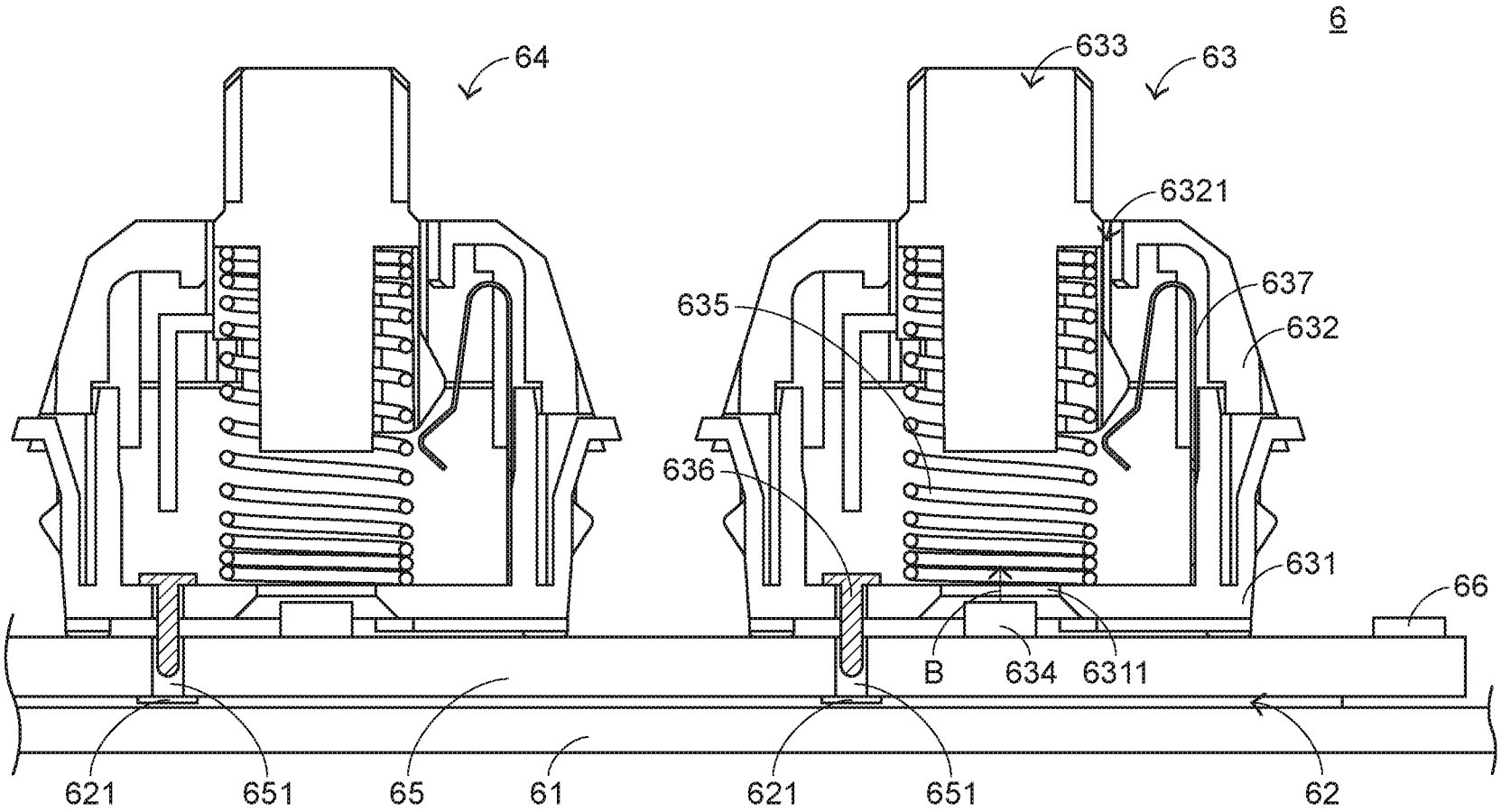
FIG. 9 is a schematic side cross-sectional view illustrating a portion of a keyboard according to a fourth embodiment of the present invention.

The present invention further provides a fourth embodiment, which is distinguished from the above embodiments. FIG. 9 is a schematic side cross-sectional view illustrating a portion of a keyboard according to a fourth embodiment of the present invention. As shown in FIG. 9, the keyboard 6 comprises a base plate 61, a pressure sensing layer 62, a first key structure 63, a second key structure 64, a circuit board 65 and a controlling unit 66. The pressure sensing layer 62 comprises plural pressure sensing regions 621. A lookup table S (see FIG. 5) recording the relationship between the magnitudes of plural forces and the magnitudes of plural travelling distances is previously stored in the controlling unit 66. The first key structure 63 comprises a keycap (not shown), a pedestal 631, an upper cover 632, a movable element 633, a light-emitting element 634, an elastic element 635, an elastomer 636 and a spring strip 637. The pedestal 631 comprises a light-transmissible region 6311 and a pedestal opening 6312. Moreover, the upper cover 632 has an upper cover opening 6321 corresponding to the movable element 633. The structures and functions of the components of the keyboard 6 which are identical to those of the third embodiment are not redundantly described herein. In comparison with the third embodiment, the position of the pressure sensing layer 62 of this embodiment is distinguished.

Please refer to FIG. 9. The pressure sensing layer 62 is disposed on the base plate 61, and located near a bottom surface of the circuit board 65. The circuit board 65 comprises plural circuit board openings 651. Each circuit board opening 651 is aligned with the pedestal opening 6312 and the elastomer 636 of the corresponding key structure (e.g., the first key structure 63). While the keycap is depressed and the movable element 633 is correspondingly moved downwardly, the extension part connected with the main body is correspondingly moved downwardly. Consequently, the elastomer 636 that is inserted in the pedestal opening 6312 is penetrated through the pedestal opening 6312 and the circuit board opening 651 to press the corresponding pressure sensing region 621. For complying with the position of the pressure sensing layer 62, the elastomer 636 of this embodiment is longer than the elastomer 536 of the third embodiment. In other words, the pressure sensing layer 62 of this embodiment is located under the circuit board 65.

Figure 10:
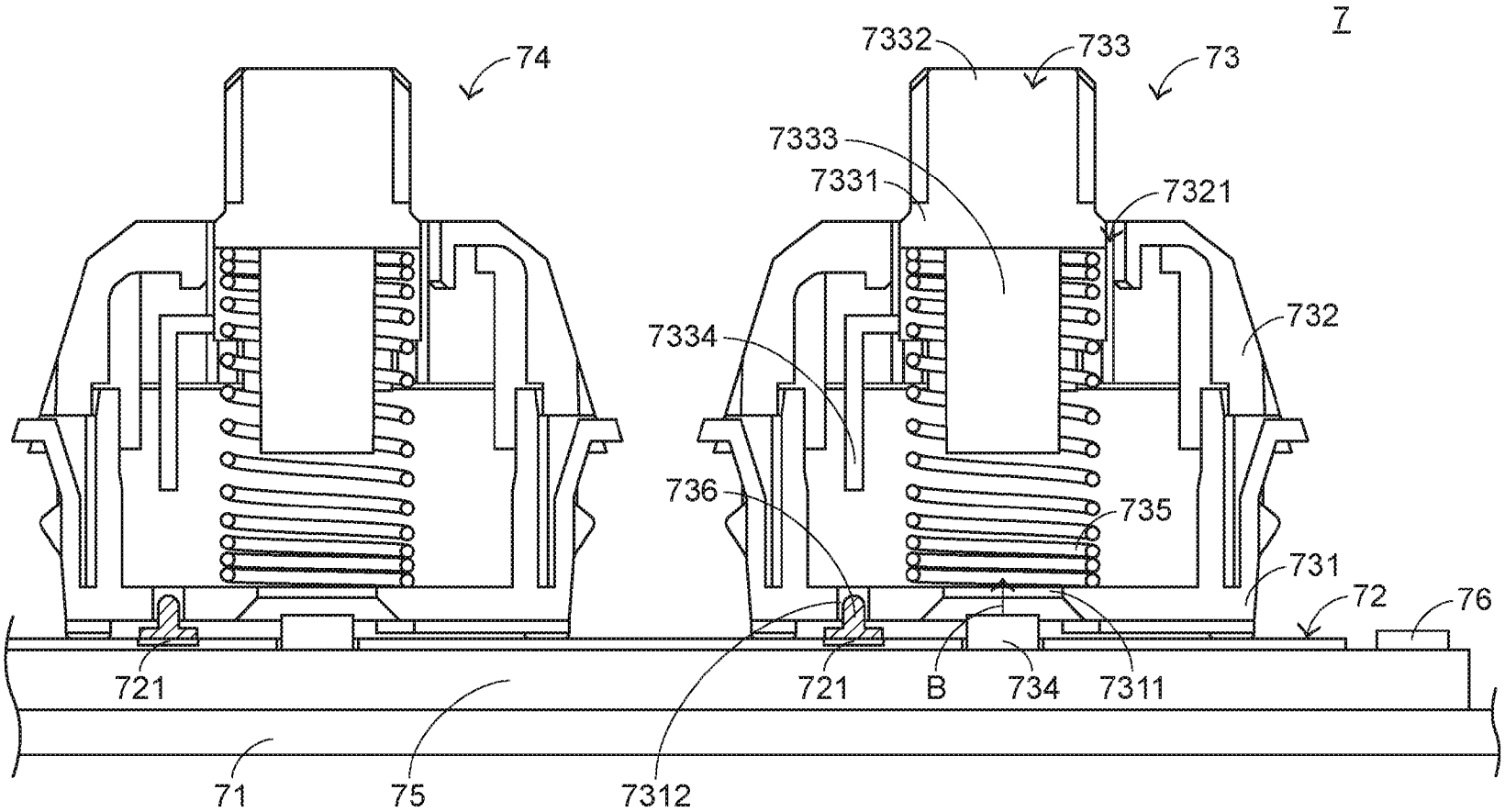
FIG. 10 is a schematic side cross-sectional view illustrating a portion of a keyboard according to a fifth embodiment of the present invention.

The present invention further provides a fifth embodiment, which is distinguished from the above embodiments. FIG. 10 is a schematic side cross-sectional view illustrating a portion of a keyboard according to a fifth embodiment of the present invention. As shown in FIG. 10, the keyboard 7 comprises a base plate 71, a pressure sensing layer 72, a first key structure 73, a second key structure 74, a circuit board 75 and a controlling unit 76. The pressure sensing layer 72 comprises plural pressure sensing regions 721. A lookup table S (see FIG. 5) recording the relationship between the magnitudes of plural forces and the magnitudes of plural travelling distances is previously stored in the controlling unit 76. The first key structure 73 comprises a keycap (not shown), a pedestal 731, an upper cover 732, a movable element 733, a light-emitting element 734, an elastic element 735 and an elastomer 736. The pedestal 731 comprises a light-transmissible region 7311 and a pedestal opening 7312. Moreover, the upper cover 732 has an upper cover opening 7321 corresponding to the movable element 733. The movable element 733 comprises a main body 7331, a coupling part 7332, a light guide post 7333 and an extension part 7334. The structures and functions of the components of the keyboard 7 which are identical to those of the first embodiment are not redundantly described herein. In comparison with the first embodiments, the installation of the elastomer 736 is distinguished.

As shown in FIG. 10, the elastomer 736 of the first key structure 73 is disposed on the corresponding pressure sensing region 721, and inserted into the pedestal opening 7312. That is, the elastomer 736 has a shape of an upright cone. While the movable element 733 is moved relative to the pedestal 731, the extension part 7334 is penetrated through the pedestal opening 7312 to push the elastomer 736. The elastomer 736 is subjected to deformation, and thus the corresponding pressure sensing region 721 is pressed by the elastomer 736.

In the embodiment, the pressure sensing layer 72 of the keyboard 7 is disposed on the top surface of the circuit board 75. It is noted that numerous modifications and alterations may be made while retaining the teachings of the invention. For example, in another embodiment, the pressure sensing layer is disposed on the base plate and located near the bottom surface of the circuit board.

Figure 11:
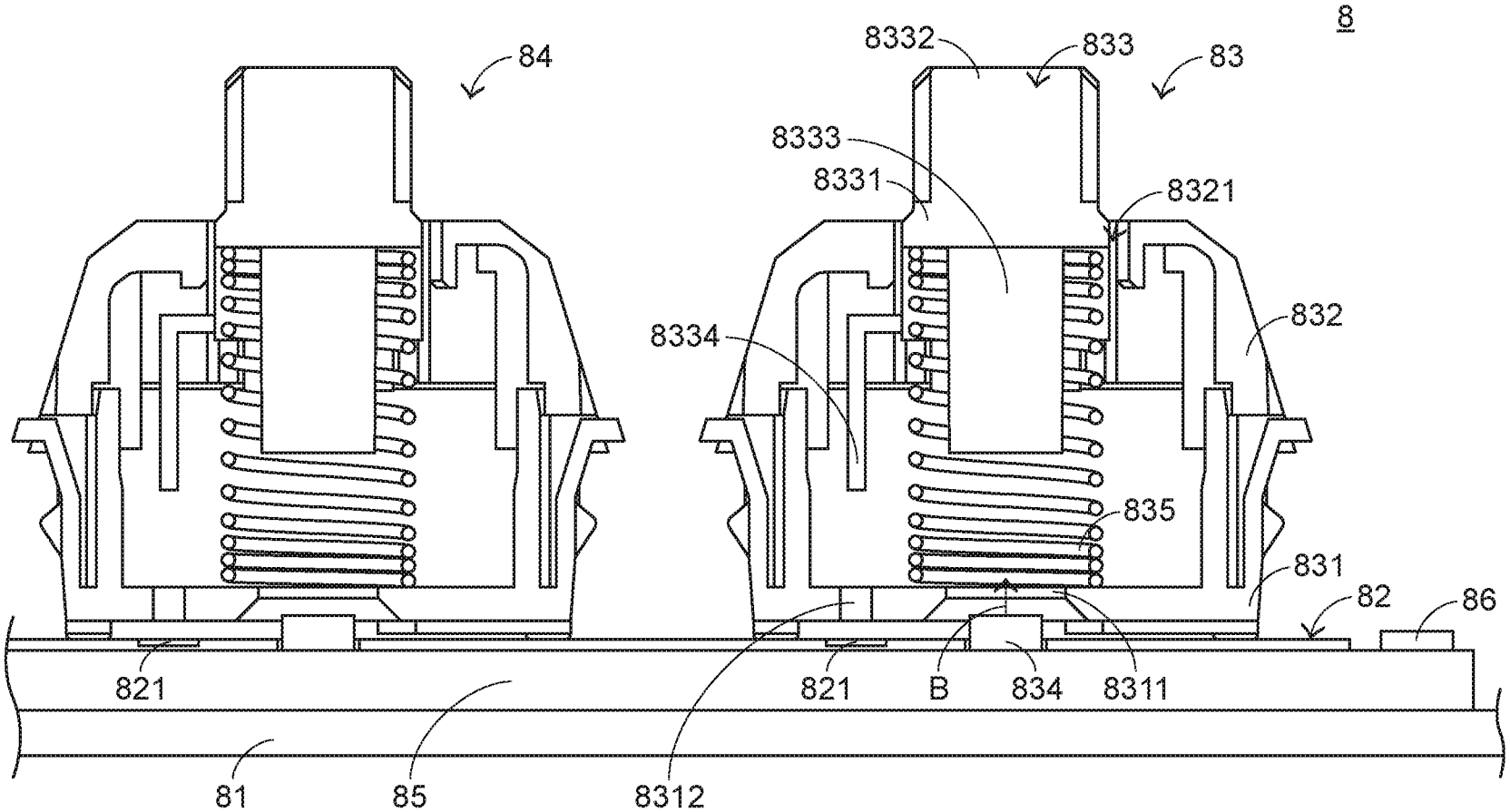
FIG. 11 is a schematic side cross-sectional view illustrating a portion of a keyboard according to a sixth embodiment of the present invention.
Figure 12:
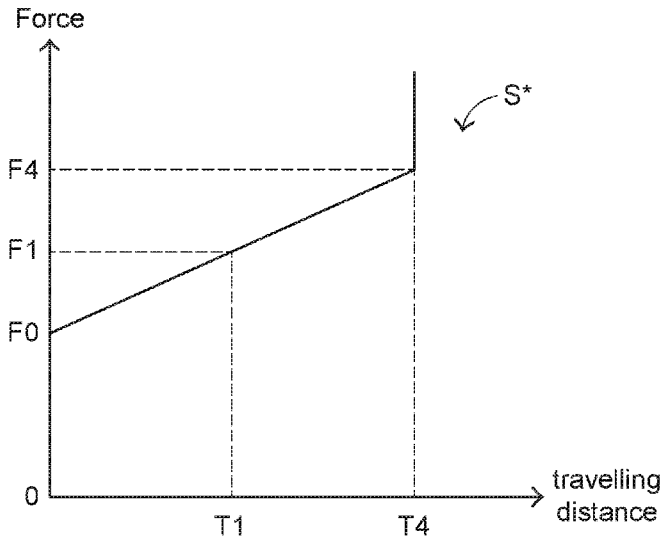
FIG. 12 is a plot illustrating the relationship between forces and travelling distances in a lookup table of the controlling unit of the keyboard according to the sixth embodiment of the present invention.

The present invention further provides a sixth embodiment, which is distinguished from the above embodiments. FIG. 11 is a schematic side cross-sectional view illustrating a portion of a keyboard according to a sixth embodiment of the present invention. FIG. 12 is a plot illustrating the relationship between forces and travelling distances in a lookup table of the controlling unit of the keyboard according to the sixth embodiment of the present invention. In this embodiment, the keyboard 8 comprises a base plate 81, a pressure sensing layer 82, a first key structure 83, a second key structure 84, a circuit board 85 and a controlling unit 86. The pressure sensing layer 82 comprises plural pressure sensing regions 821. A lookup table S* (see FIG. 12) recording the relationship between the magnitudes of plural forces and the magnitudes of plural travelling distances is previously stored in the controlling unit 86. The first key structure 83 comprises a keycap (not shown), a pedestal 831, an upper cover 832, a movable element 833, a light-emitting element 834 and an elastic element 835. The pedestal 831 comprises a light-transmissible region 8311 and a pedestal opening 8312. Moreover, the upper cover 832 has an upper cover opening 8321 corresponding to the movable element 833. The movable element 833 comprises a main body 8331, a coupling part 8332, a light guide post 8333 and an extension part 8334. The structures and functions of the components of the keyboard 8 which are identical to those of the first embodiment are not redundantly described herein. In comparison with the first embodiment, the first key structure 83 of the keyboard 8 of this embodiment is not equipped with the elastomer.

As shown in FIG. 11, the first key structure 83 is not equipped with the elastomer. The extension part 8334 of the first key structure 83 is longer than the extension part 8334 of the first embodiment. Consequently, while the movable element 833 is moved downwardly, the extension part 8334 is contacted with the corresponding pressure sensing region 821. The structures of the other components of the first key structure 83 are similar to those of the first key structure 33 of the first embodiment, and are not redundantly described herein.

Since the first key structure 83 is not equipped with the elastomer, the contents of the look-up table S* in the controlling unit 86 are different from the contents of the look-up table S of FIG. 5. In the curve of FIG. 12, the horizontal axis indicates the magnitudes of the travelling distances in the lookup table S*, and the vertical axis indicates the magnitudes of forces in the lookup table S*. Moreover, the curve of force versus travelling distance as shown in FIG. 12 is different from that of FIG. 5.

Please refer to FIG. 12 again. When the travelling distance is zero, the corresponding force is F0. That is, the keycap is not moved in response to the exerted force F0 on the first key structure 83. The reason why the keycap is not moved is that the force F0 is balanced by the elastic force of the elastic element 835. When the travelling distance is in the range between zero and T1, the exerted force is in the range between F0 and F1. That is, the exerted force F1 can overcome the elastic force and result in the moving distance T1 of the keycap. When the travelling distance is in the range between T1 and T4, the exerted force is in the range between F1 and F4. That is, as the exerted force is gradually increased, the keycap is continuously moved in response to the exerted force. When the exerted force is increased to F4, the moving distance of the keycap is only T4. As the exerted force is increased to the magnitude larger than F4, the keycap is no longer moved. The segment between the travelling distance 0 and the travelling distance T4 is linear. Moreover, the look-up table S or the look-up table S* may be selected according to the practical requirements.

In an embodiment, the keyboard of the present invention has both of an illuminating function and a pressure sensing function. For example, when the keycap is depressed lightly, the circuit board outputs the corresponding first pressure sensing signal. According to the first pressure sensing signal, the light-emitting element is controlled to generate a light beam with a first lighting effect. Whereas, when the keycap is depressed heavily, the circuit board outputs the corresponding second pressure sensing signal. According to the second pressure sensing signal, the light-emitting element is controlled to generate a light beam with a second lighting effect. For example, the light beam with the first lighting effect is a slow flickering light, and the light beam with the second lighting effect is a fast flickering light. According to the lighting effect, the user can recognize whether a lightly depressed function or a heavily depressed function is enabled. It is noted that the cooperative functions of the key structure are not restricted to the illuminating function and the pressure sensing function.

From the above descriptions, the present invention provides the keyboard with the key structure. The key structure is equipped with the light-emitting element and the movable element that is made of a light-transmissible material. Consequently, the key structure has the illuminating function. Moreover, the keyboard has the pressure sensing layer. By means of the pressure sensing layer, the key structure of the keyboard generates different pressure sensing signals according to different magnitudes of the depressing force. Since the functions of the keyboard are increased, the drawbacks of the conventional technologies are overcome. Optionally, the key structure is equipped with the spring strip according to the requirements of the user. The key structure with the spring strip can provide the depressing feedback to the user. Moreover, the key structure without the spring strip has reduced volume, and thus the key structure is slim.

Moreover, the pressure sensing layer of the keyboard comprises plural pressure sensing regions. The electrical traces of the plural pressure sensing regions are formed in the pressure sensing layer, and a single electrical connection part is located at a side of the pressure sensing layer. The pressure sensing layer is electrically connected with the circuit board through the electrical connection part. Consequently, the electrical connection between the pressure sensing layer and the circuit board is achieved. In comparison with the conventional technology, it is not necessary to sequentially electrically connect the key structures with the circuit board according to the present invention. Consequently, the assembling cost is reduced.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all modifications and similar structures.

What is claimed is:

1. A keyboard, comprising:

a base plate;

a pressure sensing layer located over the base plate, wherein the pressure sensing layer comprises plural pressure sensing regions, and each of the plural pressure sensing regions is configured to receive a first force or a second force;

a first key structure located over the pressure sensing layer, and aligned with the corresponding pressure sensing region, wherein when the corresponding pressure sensing region is pushed by the first key structure, the first key structure provides the first force or the second force to the corresponding pressure sensing region, wherein the first key structure comprises:

a pedestal comprising a pedestal opening;

an upper cover having an upper cover opening, wherein the pedestal is covered by the upper cover;

a movable element disposed on the pedestal and partially penetrated through the upper cover opening, wherein while the movable element is depressed, the movable element is moved relative to the pedestal;

an elastomer located near the movable element, wherein when the elastomer is pushed by the movable element, the elastomer is subjected to deformation and penetrated through the pedestal opening; and a spring strip, and the spring strip is installed on the pedestal and arranged beside the movable element, wherein the movable element comprises:

a main body;

an extension part extended externally from the main body, and aligned with the elastomer;

a coupling part located at a first end of the main body, and connected with a keycap; and a push part, and the push part is extended externally from the main body and located near the spring strip, wherein the elastomer is aligned with the pedestal opening, wherein while the movable element is moved relative to the pedestal, the elastomer is pushed by the extension part, and the elastomer is subjected to deformation and penetrated through the pedestal opening, so that the corresponding pressure sensing region is pressed by the elastomer, wherein while the movable element is moved relative to the pedestal, the movable element is contacted with the spring strip, so that the spring strip is swung to collide with the push part and generate a sound; and a second key structure arranged beside the first key structure, located over the pressure sensing layer, and aligned with the corresponding pressure sensing region, wherein when the corresponding pressure sensing region is pushed by the second key structure, the second key structure provides the first force or the second force to the corresponding pressure sensing region, wherein when the first key structure or the second key structure is depressed with the first force or the second force, the keyboard outputs a corresponding pressure sensing signal.

2. The keyboard according to claim 1, further comprising:

a circuit board electrically connected with the pressure sensing layer; and a controlling unit disposed on the circuit board and electrically connected with the pressure sensing layer, wherein the controlling unit outputs a first pressure sensing signal corresponding to the first force according to the first force, or the controlling unit outputs a second pressure sensing signal corresponding to the second force according to the second force.

3. The keyboard according to claim 1, wherein the elastomer is connected with the extension part and arranged beside the main body, wherein while the movable element is moved relative to the pedestal, the elastomer is moved with the extension part and penetrated through the pedestal opening, so that the corresponding pressure sensing region is pressed by the elastomer.

4. The keyboard according to claim 1, wherein the elastomer is installed on the pedestal and inserted into the pedestal opening, wherein while the movable element is moved relative to the pedestal, the elastomer is pushed by the extension part, and the elastomer is subjected to deformation and penetrated through the pedestal opening, so that the corresponding pressure sensing region is pressed by the elastomer.

5. The keyboard according to claim 1, wherein the elastomer is installed on the corresponding pressure sensing region and inserted into the pedestal opening, wherein while the movable element is moved relative to the pedestal, the extension part is inserted into the pedestal opening to push the elastomer, and the elastomer is subjected to deformation and penetrated through the pedestal opening, so that the corresponding pressure sensing region is pressed by the elastomer.

6. The keyboard according to claim 1, further comprising:

a circuit board electrically connected with the pressure sensing layer; and a controlling unit disposed on the circuit board and electrically connected with the pressure sensing layer, wherein a lookup table recording a relationship between the first force, the second force, a first travelling distance and a second travelling distance is previously stored in the controlling unit, wherein the controlling unit acquires the first travelling distance according to the first force or acquires the second travelling distance according to the second force, and the controlling unit outputs a first pressure sensing signal corresponding to the first travelling distance or outputs a second pressure sensing signal corresponding to the second travelling distance.

7. The keyboard according to claim 6, wherein when the controlling unit judges that the corresponding pressure sensing region receives the first force, the controlling unit acquires the first travelling distance corresponding to the first force according to the lookup table, and outputs the first pressure sensing signal, wherein when the controlling unit judges that the corresponding pressure sensing region receives the second force, the controlling unit acquires the second travelling distance corresponding to the second force according to the lookup table, and outputs the second pressure sensing signal.

8. The keyboard according to claim 1, wherein the movable element further comprises a light guide post, and the first key structure further comprises a light-emitting element, wherein the light guide post is located at a second end of the main body, and the light-emitting element is disposed on the circuit board, wherein the light-emitting element emits a light beam to the light guide post so as to illuminate the first key structure.

9. The keyboard according to claim 8, wherein the pressure sensing layer is disposed on a top surface of a circuit board, and the corresponding pressure sensing region has a perforation, wherein the light-emitting element is inserted into the perforation and disposed on the top surface of the circuit board.

10. The keyboard according to claim 8, wherein the pressure sensing layer is disposed on the base plate and located near a bottom surface of the circuit board, the circuit board comprises a circuit board opening, and the circuit board opening is aligned with the pedestal opening and the elastomer, wherein the elastomer which is subjected to deformation is penetrated through the pedestal opening and the circuit board opening, so that the corresponding pressure sensing region is pressed by the elastomer.

11. The keyboard according to claim 8, wherein the first key structure further comprises an elastic element, and the elastic element is sheathed around the light guide post and contacted with the pedestal to provide an elastic force, wherein the movable element is moved upwardly relative to the pedestal in response to the elastic force.

* * * * *